United States Patent [19]

Wier

[11] Patent Number: 4,545,097

[45] Date of Patent: Oct. 8, 1985

[54] LOCK FOR A SAFETY BELT

[75] Inventor: Franz Wier, Schwäbisch-Gmünd, Fed. Rep. of Germany

[73] Assignee: REPA Feinstanzwerk GmbH, Aldorf, Fed. Rep. of Germany

[21] Appl. No.: 231,026

[22] Filed: Feb. 3, 1981

[30] Foreign Application Priority Data

Feb. 5, 1980 [DE] Fed. Rep. of Germany ..... 3004150

[51] Int. Cl.[4] ..... A44B 11/26

[52] U.S. Cl. ..... 24/642; 24/641

[58] Field of Search ..... 24/230 A, 230 AL, 633, 24/634, 635, 636, 637, 639, 640, 641

[56] References Cited

U.S. PATENT DOCUMENTS

| | | | |
|---|---|---|---|
| 4,228,567 | 10/1980 | Ikesue et al. | 24/230 AL |
| 4,266,325 | 5/1981 | Ennerdal | 24/230 AL |
| 4,301,576 | 11/1981 | Cunningham | 24/230 AL |
| 4,310,953 | 1/1982 | Nanasi | 24/230 AL |
| 4,391,023 | 7/1983 | Tanaka et al. | 24/230 AL |
| 4,392,282 | 7/1983 | Wier | 24/230 AL |
| 4,393,553 | 7/1983 | Wier | 24/230 AL |
| 4,393,554 | 7/1983 | Wier | 24/230 AL |

FOREIGN PATENT DOCUMENTS

| | | | |
|---|---|---|---|
| 2813027 | 10/1978 | Fed. Rep. of Germany | 24/230 AL |

*Primary Examiner*—William E. Lyddane
*Assistant Examiner*—Peter A. Aschenbrenner
*Attorney, Agent, or Firm*—Yount & Tarolli

[57] ABSTRACT

Lock for a safety belt, with a belt lock into which an insertion tab can be inserted and can be locked by a locking latch, as well as with a pushbutton which can be shifted parallel to the insertion path of the insertion tab against a spring force, and through the operation of which the locking latch can be moved against the force of a compression spring from a locking position into the opening position. A spring tab which is clamped on one side and is arranged substantially parallel to the shifting path of the pushbutton is provided as the compression spring. The pressure of the spring decreases when the pushbutton is shifted into the opening position, as the effective spring length between the clamping point and the point of attach of the force becomes larger.

17 Claims, 2 Drawing Figures

LOCK FOR A SAFETY BELT

CROSS-REFERENCES TO RELATED APPLICATION

The following application is related to the present application: application Ser. No. 231,012, filed by Franzwier on Feb. 3, 1981, entitled "Lock for a Safety Belt".

BACKGROUND OF THE INVENTION

1. Field of the Invention

The invention relates to a lock for a safety belt into which an insertion tab can be inserted and can be locked by a locking latch. The lock has a pushbutton which can be shifted parallel to the insertion path of the insertion tab against a spring force. Through the operation of the pushbutton, the locking latch can be moved against the force of a compression spring from a locking position into the opening position.

2. Description of the Prior Art

In known safety belt systems of the aobve-mentioned type, the locking latch is pressed into the locked position by a spring force if the pushbutton is not operated. If the pushbutton is pushed in, the first-mentioned spring force must be overcome for moving the locking latch along a shift path which is perpendicular to the shift path of the pushbutton, possibly in addition to the spring force which pushes the pushbutton into the unoperated position; this spring force increases with increasing pushbutton stroke, which makes the operation of the pushbutton more difficult. The two above-mentioned spring forces progressively increase with increasing pushbutton stroke.

SUMMARY OF THE INVENTION

It is an object of the invention to provide a lock of the above-mentioned type in which the operation of the pushbutton is facilitated.

With the foregoing and other objects in view, there is provided in accordance with the invention a lock for a safety belt comprising a belt lock having a metallic support with two spaced plates defining an insertion path, an insertion tab attached to a belt end for insertion in the insertion path of the metallic support, a latching bolt movable transversely to the insertion path of the blocked position in which the bolt is interposed in the path of said tab and to the open position in which the bolt does not block passage of the tab in the insertion path, a pushbutton mounted on the metallic support movable parallel to the insertion path against the force of a spring to move the latching bolt from the blocked position to the open position against the force of a compression spring urging the latching bolt to closed position, said compression spring is a spring tab which is clamped on one side and arranged approximately parallel to the movable path of the pushbutton whereby movement of the pushbutton along its movable path causes an increase of distance between the clamping point of the spring and point at which said force of the compression spring is applied with consequent decrease in said force at said latter point.

Other features which are considered as characteristic for the invention are set forth in the appended claims.

Although the invention is illustrated and described herein as embodied in a lock for a safety belt, it is nevertheless not intended to be limited to the details shown, since various modifications may be made therein without departing from the spirit of the invention and within the scope and range of equivalents of the claims.

BRIEF DESCRIPTION OF THE INVENTION

The invention, however, together with additional objects and advantages thereof will be best understood from the following description when read in connection with the accompanying drawings, in which:

FIG. 1 shows a cross-sectional view of the lock for a safety belt according to the invention, showing the relationship of insertion path, locking latch, movable pushbutton and spring tab, and FIG. 2 shows an exploded view of the pushbutton, locking latch and spring tab according to FIG. 1.

DETAILED DESCRIPTION OF THE INVENTION

Figure 1:
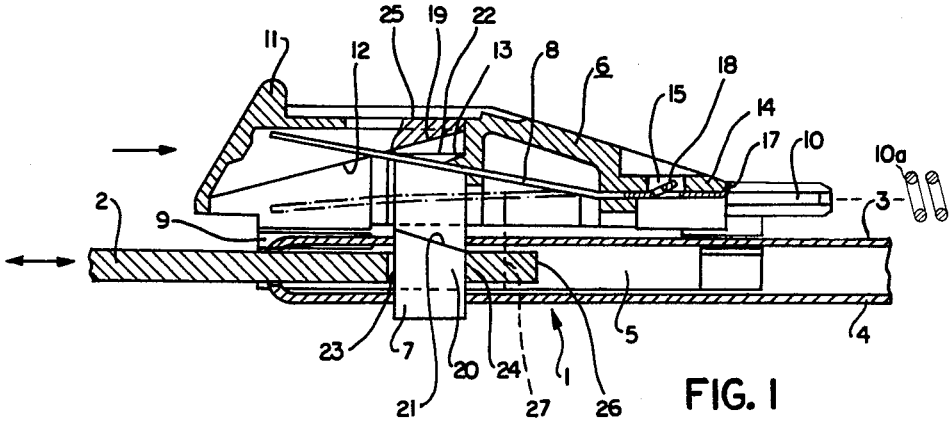

In accordance with the invention, a spring tab which is clamped on one side and is arranged substantially parallel to the shifting or moving path of the pushbutton is provided as the compression spring. The pressure of the spring tab decreases when the push button is shifted into the opening position, as the effective spring length, that is, distance, between the clamping point and the point of attack of the force becomes larger.

Thus, by the particular arrangement of the spring tab, when the pushbutton is pressed-in the direction of its opening position, the effective pressure force of the spring tab becomes accordingly less due to the increasingly longer lever arm between the clamping point and the point of attack of the force. In this manner the force required for pushing-in the pushbutton becomes relatively smalle due to this spring force. If this pushbutton is further under the action of one or several other springs, the spring force attacking, i.e. pressing, at the locking latch is not increasingly added to the additional spring forces during movement of the pushbutton, whereby overall the operation of the pushbutton is facilitated substantially.

Figure 2:
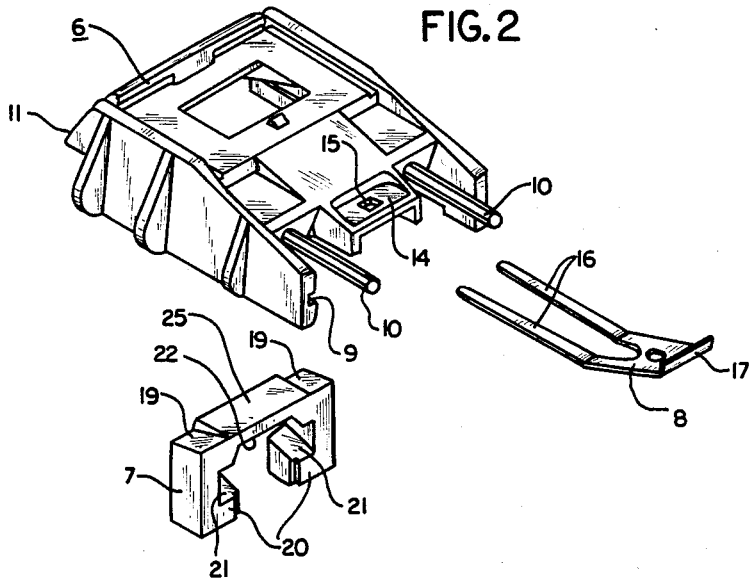

Within this scope of the present invention the possibility exists of clamping the spring tab in a stationary manner at the support of the belt lock, preferably at the height of the end of the pushbutton on the pressure side, where the pushbutton can be moved relative to this spring tab, slowly increasing its spring length, or, in accordance with the subsequently described embodiment example, the spring tab can be fastened directly to the pushbutton according to an advantageous embodiment in which the spring tab is fastened at the front end, as seen in the shifting direction of the pushbutton and pushes the locking latch which can be shifted perpendicularly to the shifting path, against a lifting surface of the pushbutton which is inclined relative to the shifting path. Further advantageous embodiments of the invention are seen from the embodiment example which is shown in the drawing and will be described in the following:

In the view according to FIG. 1, a belt lock is generally designated by numeral 1 and an insertion tab with 2. The belt lock consists substantially of a metallic support 3/4 with two plates 3 and 4 which define the insertion path 5 for the insertion tab 2. The belt lock 1 can be fastened, for instance, by means of a cable, to the bottom of the motor vehicle. Shown as a detail in FIG. 2, is a pushbutton 6, a locking latch 7, as well as of a fork-like spring tab 8. The pushbutton 6 has guide slots 9 arranged on both sides, by which it is guided in corresponding guide edges of the upper plate 3 of the support 3/4, parallel to the insertion direction (arrow FIG. 1). At cantilevered pins 10 of the pushbutton 6, compression springs not shown, are held which are braced against an abutment, likewise not shown, of the support 3/4. The pushbutton 6 can be moved against the spring force in the direction of the arrow by pushing by hand on a handle 11.

The pushbutton 6 further has, offset on both sides relative to the center of the insertion path, two inclined track-like lifting surfaces 12. A projection-like detent element 13 is centered at the height of the ends of the lifting surfaces 12. A mounting 14 is disposed at the rear end of pushbutton 6. A spring tab 8 having two spring tines 16 is supported in an opening 15. The common fastening end of a bent-off extension 17 of the spring tab 8 extends around the mounting 14, while a spring lug 18 is clamped in the opening 15. The spring tab 8 which in FIGS. 1 and 2 is pretensioned upward, is braced against the detent element 13 and pushes the locking latch 7 with its two inclined sliding surfaces 19 onto the lifting surfaces 12 of the pushbutton 6. The locking latch 7 is C-shaped in design in the embodiment example, its free legs having latch extensions 20 which are provided with bevels 21.

FIG. 1 shows the locking or latching position of the lock, in which the locking latch 7 is pushed by the spring tab 8 into the uppermost lifting position of the lifting surfaces 12 and in which the locking latch is detented with the lower edge 22 of the middle or non-free leg behind the detent element 13. In this position, the latch extensions 20 of the locking latch 7 are at the height of the insertion path 5 as well as in a locking opening 23 of the insertion tab 2, the latching edge 24 of which is braced against the vertical part of the latch extensions 20. To open the lock, the pushbutton 6 is shifted in the direction of the arrow against the force of a spring, whereby the locking latch 7 and the detent extension 13 become disengaged and whereby the locking latch 7 is shifted along the lifting surfaces 12 against the force of the spring tab 8 downward into the opening position, the locking latch 7 being guided in guide openings in the plates 3, 4. In a certain shift position, the locking edge 24 comes into an engagement with the inclines 21, whereby a force component directed in the opening position acts on the locking latch 7 and pushes the latter into the opening position, in which the locking latch is detented again with its upper edge 25 behind the detent element 13 of the pushbutton 6 which has returned into the rest position, and is locked. Additionally, the locking latch 7 can be held in the opening position by a resilient ejector, not shown, which is guided in the insertion path 5, and blocks the shifting path of the latch extensions 20 as the insertion tab 2 is withdrawn. During the shifting motion of the locking latch 7, the latter is continuously pushed by the spring tab 8 against the lifting surfaces 12, and in the course of the shifting of the push button, the effective spring travel of the spring tab 8 becomes larger and the pressure force to be supplied at the pushbutton 6 becomes therefore smaller. In FIG. 1, the lowest position of the spring tab 8, i.e. after the pushbutton 6 is pushed-in completely, is indicated dash-dotted.

If the insertion tab 2 is inserted into the insertion path 5, the front edge 26 of the insertion tab 2 comes into contact with a stop 27 of the pushbutton 6, extending into the insertion path 5, and shifts the latter so far that the detent connection between the detent element 13 and the locking latch 7 is released, whereby the locking latch 7 drops back abruptly and with an audible click into the locking position under the force of the spring tab 8.

I claim:

1. A buckle assembly for use with a seat belt to restrain an occupant of a vehicle, said buckle assembly comprising a base which at least partially defines an opening into which a tongue is insertable, a latch member movable transversely to the path of insertion of the tongue into said base, said latch member being movable between an engaged position extending into the path of movement of the tongue to block withdrawal of the tongue from said buckle assembly and a release position in which said latch member is ineffective to block withdrawal of the tongue from said buckle assembly, a slide member movable along the base transversely to the path of movement of said latch member, said slide member being movable along said base between an extended position and a retracted position, actuator surface means on said slide member for moving said latch member to the release position upon movement of said slide member from the extended position to the retracted position, spring means for urging said latch member toward the engaged position, first detent surface means connected with said slide member for engaging a first side surface area on said latch member to hold said latch member in the release position against the influence of said spring means, and second detent surface means connected with said slide member for engaging a second side surface area on said latch member to hold said latch member in the engaged position, said first detent surface means being movable out of engagement with said first side surface area on said latch member by movement of said slide member from the extended position toward the retracted position to release said latch member for movement from the release position to the engaged position under the influence of said spring means, said second detent surface means being movable into engagement with said second side surface area on said latch member by movement of said slide member from the retracted position to the extended position with said latch member in the engaged position.

2. A buckle assembly as set forth in claim 1 further including surface means on said latch member slidably engaging the tongue during insertion of the tongue into the opening in said base to hold said latch member in the release position during insertion of the tongue into the opening to thereby prevent movement of said latch member to the engaged position.

3. A buckle assembly as set forth in claim 1 wherein said actuator surface means includes an elongated cam surface which extends at an acute angle to the path of movement of said slide member and engages a follower surface on said latch member, said cam surface being slidable on said follower surface to move said latch member from the engaged position to the release position against the influence of said spring means upon inward movement of said slide member from the extended position to the retracted position, said second detent surface means being movable with said slide member from a position of abutting engagement with said latch member to a position spaced from said latch member during movement of said slide member to the retracted position, said first detent surface means being movable from a position spaced from said latch member to a position of abutting engagement with said latch member upon movement of said slide member from the retracted position to the extended position with said latch member in the release position, said spring means eing effective to press said latch member against said first detent surface means when said slide member is in the extended position and said latch member is in the release position.

4. A buckle assembly as set forth in claim 3 wherein said second detent surface means faces toward said cam surface and said first detent surface means faces away from said cam surface.

5. A buckle assembly as set forth in claim 3 wherein a portion of said latch member is disposed between said second detent surface means and said cam surface when said latch member is in the engaged position.

6. A buckle assembly for use with a seat belt to restrain an occupant of a vehicle, said buckle assembly comprising a base which at least partially defines an opening into which a tongue is insertable, a latch member movable transversely to the path of insertion of the tongue into said base, said latch member being movable between an engaged position extending into the path of movement of the tongue to block withdrawal of the tongue from said buckle assembly and a release position in which said latch member is ineffective to block withdrawal of the tongue from said buckle assembly, a slide member movable along the base transversely to the path of movement of said latch member, said slide member being movable along said base between an extended position and a retracted position, cam surface means on said slide member and extending at an acute angle to the path of movement of said slide member for moving said latch member to the release position upon movement of said slide member from the extended position to the retracted position, spring means on said slide member for urging said latch member toward the engaged position, said spring means including a spring member having a first end portion connected to said slide member for movement therewith relative to said base and a second end portion which engages said latch member, said second end portion of said spring member being movable relative to said latch member upon movement of said slide member between the extended and retracted positions.

7. A buckle assembly as set forth in claim 6 further including first detent surface means connected with said slide member and facing away from said cam surface means for holding said latch member in the release position against the influence of said spring means when said slide member is in the extended position prior to insertion of the tongue into said buckle assembly and second detent surface means connected with said slide member for holding said latch member in the engaged position when said slide member is in the extended position with the tongue inserted in said buckle assembly.

8. A buckle assembly as set forth in claim 6 wherein slide member has a manually engageable outer end portion disposed adjacent to the opening in said base into which the tongue is inserted and an inner end portion opposite of the outer end portion of said slide member, said inner end portion of said slide member including a spring mounting surface extending parallel to the path of movement of said slide member relative to said base and a cross section extending across said mounting surface and spaced from said mounting surface to at least partially define a slot, said first end portion of said spring member extending through said slot and is disposed in abutting engagement with said spring mounting surface, said first end portion of said spring member hving a shoulder which engages said slide member to locate said first end portion of said spring member in a predetermined position relative to said spring mounting surface.

9. A seat belt buckle comprising a base having an opening into which a tongue is insertable, a latch member movable between an engaged position blocking withdrawal of the tongue from the buckle and a release position in which said latch member is ineffective to block withdrawal of the tongue from the buckle, a slide member movable along the base to move said latch member to the release position, and spring means mounted on said slide member and movable therewith for urging said latch member toward the engaged position with a force that decreases as said slide member moves in a direction to release said latch member.

10. A seat belt buckle as set forth in claim 9 wherein said spring means includes a leaf spring having a first end portion connected with said slide member and a second end portion disposed in engagement with said latch member.

11. A seat belt buckle as set forth in claim 10 wherein said second end portion of said leaf spring is disposed in engagement with said latch member at a first location which is a first distance from said first end portion of said leaf spring when said latch member is in the engaged position and is disposed in engagement with said latch member at a second location which is a second distance from said first end portion of said leaf spring when said latch member is in the release position, said second distance being greater than said first distance.

12. A buckle assembly as set forth in claim 11 wherein said slide member has a cam surface disposed in a plane which extends at an acute angle to the path of movement of said slide member and engages a follower surface on said latch member, said cam surface being slidable along said follower surface to move said latch member from the engaged position to the release position against the influence of said spring means upon inward movement of said slide member from an extended position to a retracted position in the direction of insertion of the tongue into said base, said first end portion of said leaf spring being connected with an inner end portion of said slide member at a location disposed on a first side of the plane containing said cam surface, said second end portion of said leaf spring extends through the plane which contains said cam surface when said slide member is in the extended position and said latch member is in the engaged position, said leaf spring being disposed entirely on the first side of the plane containing said cam surface when said slide member is in the retracted position and said latch member is in the release position.

13. A buckle assembly as set forth in claim 11 wherein said slide member has a pair of spaced apart and parallel cam surfaces which extend at an acute angle to the path of movement of said slide member, said latch member having a pair of spaced apart and parallel follower surfaces disposed in abutting engagement with said cam surfaces, said second end portion of said leaf spring being disposed in engagement with a portion of said latch member between said follower surfaces.

14. A buckle assembly as set forth in claim 11 wherein slide member has a manually engageable outer end portion disposed adjacent to the opening in said base into which the tongue is inserted and an inner end portion opposite of the outer end portion of said slide member, said inner end portion of said slide member including a flat spring mounting surface extending parallel to the path of movement of said slide member relative to said base and a portion extending across said mounting surface and spaced from said mounting surface to at least partially define a slot, said first end portion of said leaf spring extends through said slot and is disposed in abutting engagement with said spring mounting surface, said first end portion of said leaf spring having a shoulder which extends across the first end portion of said leaf spring and engages said slide member to locate said first end portion of said leaf spring in a predetermined position relative to said spring mounting surface.

15. A buckle assembly as set forth in claim 9 further including first detent surface means connected with said slide member for holding said latch member in the release position against the influence of said spring means when said latch member is in the release position and second detent surface means connected with said slide member for holding said latch member in the engaged position.

16. A buckle assembly as set forth in claim 15 further including a cam surface disposed on said slide member and extending at an acute angle to the path of movement of said slide member, and said latch member includes a follower surface which is engageable with said cam surface, said cam surface being slidable relative to said follower surface to move said latch member from the engaged position to the release position against the influence of said spring means upon inward movement of said slide member from an extended position to a retracted position in the direction of insertion of the tongue into said base, said second detent surface means being movable with said slide member from a position of abutting engagement with said latch member to a position spaced from said latch member during movement of said slide member to the retracted position, said first detent surface means being movable from a position spaced from said latch member to a position of abutting engagement with said latch member upon movement of said slide member from the retracted position to the extended position with said latch member in the release position, said spring means being effective to press said latch member against said first detent surface means when said slide member is in the extended position and said latch member is in the release position.

17. A buckle assembly as set forth in claim 16 wherein said second detent surface means faces toward said cam surface and said first detent surface means faces away from said cam surface.

* * * * *

UNITED STATES PATENT AND TRADEMARK OFFICE

CERTIFICATE OF CORRECTION

PATENT NO. : 4,545,097

DATED : October 8, 1985

INVENTOR(S) : Franz Wier

It is certified that error appears in the above-identified patent and that said Letters Patent are hereby corrected as shown below:

Column 5, line 3, change "eing" to -- being --.

Column 6, line 2, change "hving" to -- having --.

Signed and Sealed this

*Twenty-ninth* Day of *April 1986*

[SEAL]

*Attest:*

DONALD J. QUIGG

*Attesting Officer*

*Commissioner of Patents and Trademarks*